US007128448B2

(12) United States Patent
Fischer et al.

(10) Patent No.: US 7,128,448 B2
(45) Date of Patent: Oct. 31, 2006

(54) LAMP HAVING A ROTATABLE BASE

(75) Inventors: Klaus Fischer, Friedberg (DE); Andreas Jakob, Langerringen (DE)

(73) Assignee: Patent-Treuhand-Gesellschaft fur Elektrisch Gluhlampen mbH, Munich (DE)

( * ) Notice: Subject to any disclaimer, the term of this patent is extended or adjusted under 35 U.S.C. 154(b) by 145 days.

(21) Appl. No.: 10/826,380

(22) Filed: Apr. 19, 2004

(65) Prior Publication Data

US 2004/0233669 A1 Nov. 25, 2004

(30) Foreign Application Priority Data

May 21, 2003 (DE) ..... 103 22 987

(51) Int. Cl.
*F21V 15/01* (2006.01)
*F21V 15/015* (2006.01)

(52) U.S. Cl. ..... 362/378; 362/649; 362/260

(58) Field of Classification Search ..... 362/260, 362/263, 276, 640, 642, 647, 649, 650, 651, 362/378, 377, 353, 457, 441, 216, 255, 265; 313/113, 115, 318.05, 318.11, 318.09
See application file for complete search history.

(56) References Cited

U.S. PATENT DOCUMENTS

| | | | | |
|---|---|---|---|---|
| 4,624,513 | A | 11/1986 | Haraden | 339/1 L |
| 4,654,557 | A | 3/1987 | Haraden | 313/318 |
| 4,660,906 | A | 4/1987 | Haraden | 339/2 L |
| 5,667,296 | A * | 9/1997 | Cheng et al. | 362/378 |
| 6,296,375 | B1 * | 10/2001 | Sung et al. | 362/255 |
| 6,580,221 | B1 * | 6/2003 | Hutzler et al. | 362/276 |

* cited by examiner

*Primary Examiner*—Sandra O'Shea
*Assistant Examiner*—Bao Q. Truong
(74) *Attorney, Agent, or Firm*—Carlo S. Bessone

(57) ABSTRACT

The invention relates to an electric lamp including at least one vessel for producing and emitting visible electromagnetic radiation, a base for securing and making electrical contact with the lamp in a luminaire fitting, and a connecting part which connects the base to one of the remaining parts of the lamp. The connecting part is in the form of a rotationally symmetrical rotary device which allows the remaining parts of the lamp to be rotated with respect to the base, when the base is secured in the fitting, about the axis of the lamp.

9 Claims, 2 Drawing Sheets

LAMP HAVING A ROTATABLE BASE

TECHNICAL FIELD

The invention is based on an electric lamp comprising at least one vessel for producing and emitting visible electromagnetic radiation, a base for securing and making electrical contact with the lamp in a luminaire fitting, and a connecting part which connects the base to one of the remaining parts of the lamp.

BACKGROUND ART

All lamps on the market today have a base which is firmly connected to the lamp vessel and other parts of the lamp for the purpose of mechanically and electrically connecting it to the luminaire fittings. In this case, the precise design of this base is insignificant. It may be, for example, a plug-in base, a screw-in base or a bayonet-type base.

However, there are lamps which have integrated sensors for detecting particular events which when they occur can lead to changes in the operation of the lamp.

For example, there are lamps which detect the ambient brightness by means of light-sensitive sensors and thus, as a function of this ambient light, automatically switch themselves on and off.

Also conceivable are lamps in which sensors for detecting movements can be provided. Such lamps switch themselves on automatically when objects (people, animals, movable items) move in a defined detection area.

However, in the case of lamps having integrated sensors there is the problem that, on the one hand, the geometrical alignment of the sensors is determined by a desired spatial detection range, and, on the other hand, the rigid electrical and mechanical connection of the sensors to the base means that it is not possible to align the sensors in any desired manner.

Existing lamps having sensors solve the above-described problem by, for example, two or more sensors acting in parallel being incorporated on the lamp in an intermediate part between the lamp vessel and the base such that they are distributed over the circumference of the lamp, and these sensors extend the possible detection area surrounding the lamp.

Disadvantages of this are that the component costs of the lamp are disproportionately high owing to the relatively expensive sensors and that steps have to be taken in terms of circuitry to evaluate two or more sensors in parallel (for example averaging).

In the case of active sensors for detecting movement, a considerably increased transmission power must also be provided owing to the possibility, brought about by the rigid connection between the lamp and the luminaire, that the detection area does not correspond to the desired area.

One object of the invention is therefore to provide a lamp design which avoids the abovementioned disadvantages.

DISCLOSURE OF THE INVENTION

In the case of the electric lamp comprising at least one vessel, from which visible electromagnetic radiation is emitted, a base for securing and making electrical contact with the lamp in a luminaire fitting, and a connecting part which connects the base to one of the remaining parts of the lamp, the object is achieved by the connecting part being in the form of a rotationally symmetrical rotary device which makes it possible for the remaining parts of the lamp to be rotated with respect to the base, when the base is secured in the fitting, about the axis of the lamp.

The device advantageously comprises two parts which are latched into one another, the second part being connected to the base of the lamp, and the first part being connected to one of the remaining components of the lamp. The rotary mechanism for rotating the base with respect to the other parts of the lamp may be of very simple design if one of the two parts of the rotary device has a peripheral groove into which a peripheral tongue of the other part of the rotary device engages.

In order to prevent the power supply wires being torn away from the base of the lamp vessel, the rotary device is designed such that the rotation is limited to a maximum of 360°. It is thus easily possible to align the lamp in an optimum manner. For this purpose, each of the two parts of the rotary device advantageously has a stop, the two stops being arranged such that, at a specific angle of rotation, they come into contact with one another between the two housing parts and prevent any further rotation.

The lamp may be an incandescent or halogen incandescent lamp, the vessel in this case comprising a glass bulb in which light is produced by means of an incandescent filament.

However, the lamp may also be a discharge lamp, such as a compact low-pressure discharge lamp, for example. In this case, the vessel comprises a tube which is bent in one or more places, and in whose ends electrodes are sealed. With the aid of a mercury inert gas filling, UV radiation is produced in the vessel which is converted, by means of a fluorescent coating on the inner wall of the vessel, into visible radiation.

Since a discharge lamp always requires a ballast for operating the lamp, for this purpose a housing for accommodating an electrical or electronic circuit may also be arranged between the vessel and the rotary device.

If the lamp is equipped with a brightness or movement sensor, it is advantageously fitted on the second part of the rotary device, which faces the vessel, or on the housing for accommodating the circuit. This makes it possible, when the base is inserted firmly in the fitting, for the sensor to be rotated in any desired direction. Of course, it is also conceivable to equip a lamp with a temperature sensor or a smoke sensor.

BRIEF DESCRIPTION OF THE DRAWINGS

The invention is described by way of example below with reference to a compact low-pressure discharge lamp (compact fluorescent lamp) equipped with a sensor. In the drawings.

BEST MODE FOR CARRYING OUT THE INVENTION

Figure 1:
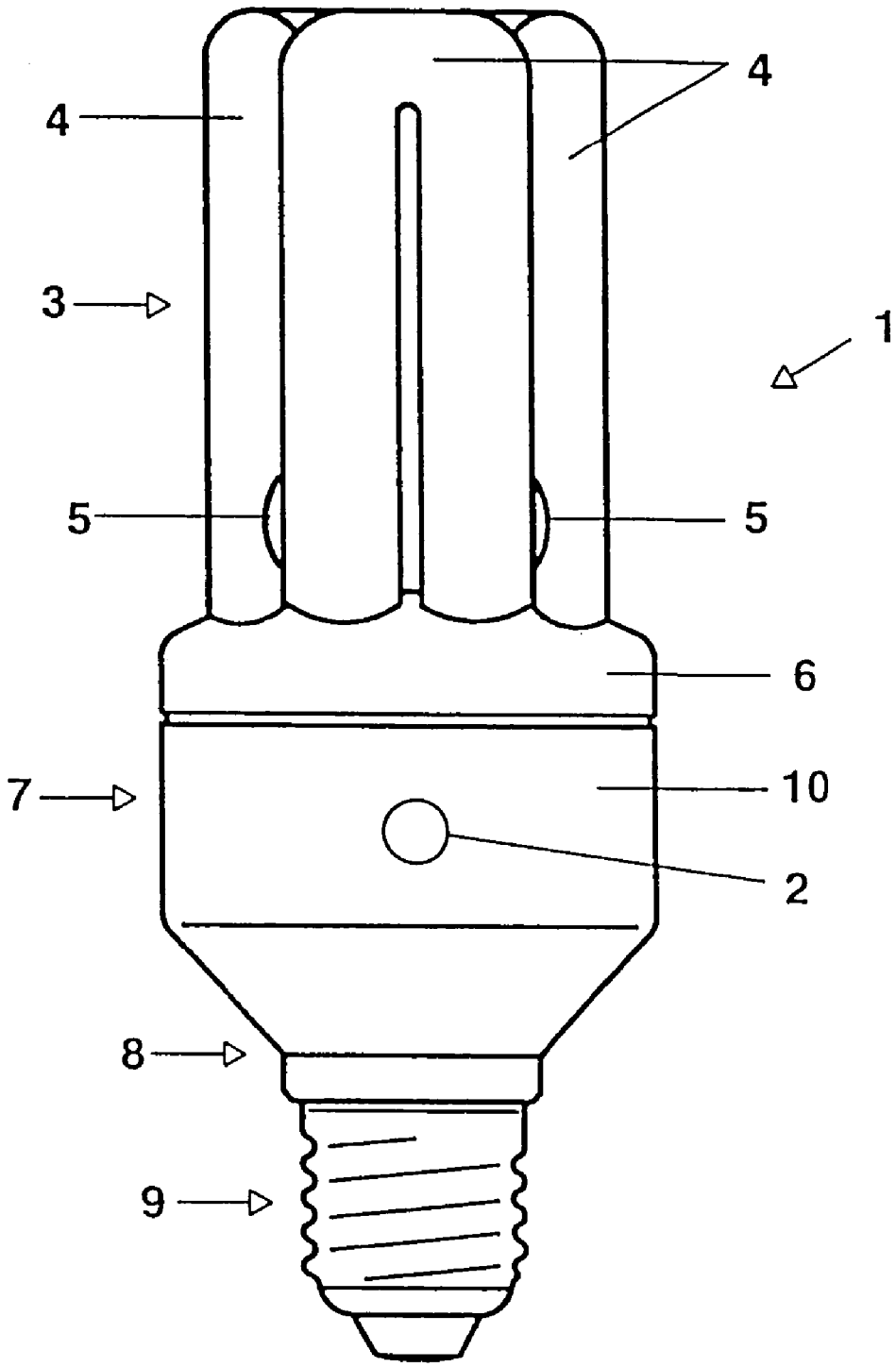
FIG. 1 shows a side view of the compact fluorescent lamp according to the invention.

FIG. 1 shows a compact fluorescent lamp 1 according to the invention having a brightness or movement sensor 2.

The compact fluorescent lamp 1 has a discharge vessel 3, which comprises three tube parts 4 which are bent in the form of a U and are connected, by means of connecting webs 5, to form a single, continuous discharge path. The ends of the U-shaped tube parts 4 are secured in the lid 6 of a rotationally symmetrical plastic housing 7 which accommodates an electronic ballast for operating the lamp 1. The housing 7 merges with a rotary device 8 which has, at its other end, a type E27 base 9 for mechanically securing it in a luminaire and for making electrical contact between the lamp and the voltage-carrying parts of the luminaire. In addition, the brightness or movement sensor 2 is fitted on the casing 10 of the housing 7.

Figure 2A:
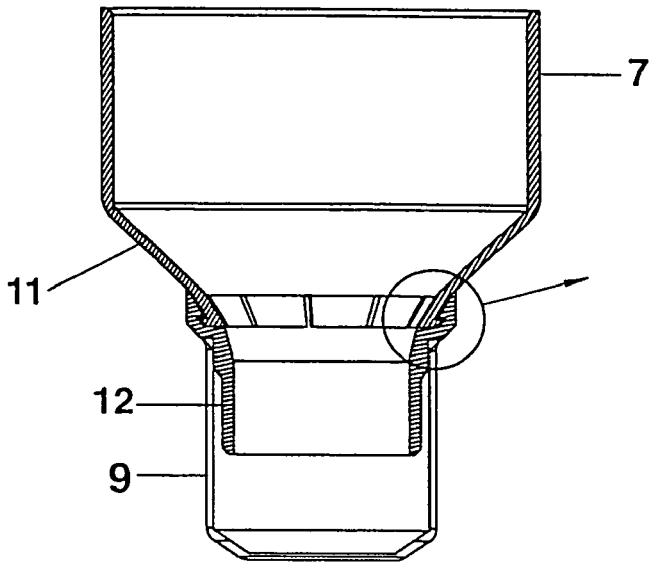
FIG. 2*a* shows a section, from the side, through the rotary device with a housing and a base fitted in the case of the compact fluorescent lamp according to the invention.
Figure 2B:
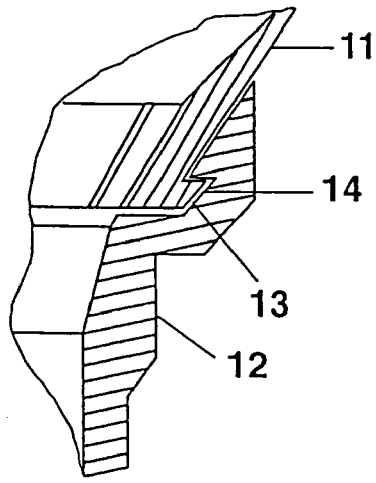
FIG. 2*b* shows a detail of the rotary device for the purpose of depicting the connecting technique shown in FIG. 2*a*.

FIGS. 2*a* and 2*b* show schematic sections of the rotary device 8. Said rotary device 8 comprises a first part 11 which merges directly with the housing 7 for accommodating the ballast. The second part 12 bears the base 9 which is only depicted schematically here. The rotary mechanism of the device 8 is achieved, as is shown enlarged in FIG. 2*b*, by a peripheral tongue 13 on the part 11 which is snapped into a groove 14 on the part 12. This snap-connection acts in an interlocking manner only between the parts 11 and 12, but rotation between the parts 11 and 12 is possible.

Figure 3:
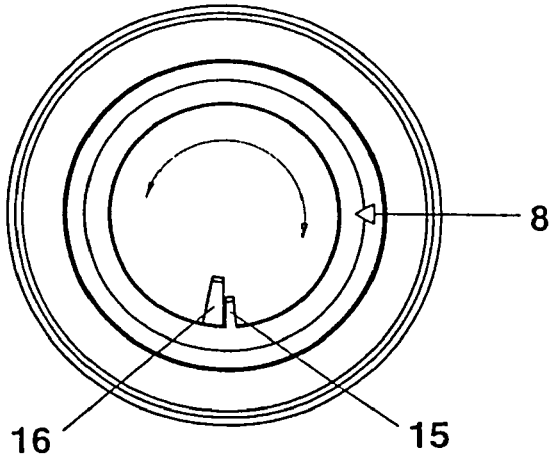
FIG. 3 shows a plan view of the rotary device with a housing and a base fitted.

As can be seen from the plan view in FIG. 3, the rotary device 8 has, on its first part 11 and on its second part 12, in each case one inwardly pointing stop 15 and 16, respectively, which lie in the same plane. These stops limit the angle of rotation of the two parts 11 and 12 to a maximum angle of rotation of approximately 360°.

In practice, the following procedure is followed when screwing in and unscrewing the lamp:

When screwing the lamp 1 into a fitting, part 11 of the rotary device 8 is rotated with respect to part 12 until the stops 15 and 16 for limiting the angle of rotation prevent any further rotation. The lamp 1 can thus be screwed into the luminaire fitting with the required force. When a sufficiently firm connection is achieved between the lamp and the luminaire, the lamp 1 can be rotated back counter to the screwing-in direction until the detection range of a sensor corresponds to the range required by the spatial conditions. When unscrewing the lamp 1 (for example at the end of its life), part 11 is rotated further with respect to part 12 counter to the screwing-in direction until the stops 15, 16 for limiting the angle of rotation again prevent any further rotation and the base 9 is unscrewed from the luminaire fitting.

What is claimed is:

1. An electric lamp comprising at least one vessel for producing and emitting visible electromagnetic radiation, a base for securing and making electrical contact with the lamp in a luminaire fitting, and a rotationally symmetrical rotary device connecting the base to a housing, the housing accommodates an electrical or electronic circuit for lamp operation which is arranged between the at least one vessel and the rotary device, wherein the rotary device allows the housing to be rotated with respect to the base, when the base is secured in the luminaire fitting, about the axis of the lamp, the rotary device comprises a second part connected to the base of the lamp, and a first part connected to an outer surface of the housing, the first and second parts of the rotary device are latched into one another.

2. The electric lamp as claimed in claim 1, wherein the first or second part of the rotary device has a peripheral groove into which a peripheral tongue of the other first or second part of the rotary device engages.

3. The electric lamp as claimed in claim 1, wherein rotation of the rotary device is limited to a maximum of 360°.

4. The electric lamp as claimed in claim 2, wherein each of the first and second parts of the rotary device has a stop, the two stops being arranged, at a specific angle of rotation, so as to come into contact with one another between the first and second parts of the rotary device and prevent any further rotation.

5. The electric lamp as claimed in claim 1, wherein the lamp is an incandescent lamp.

6. The electric lamp as claimed in claim 1, wherein the lamp is a discharge lamp.

7. The electric lamp as claimed in claim 1, wherein the lamp is a compact low-pressure discharge lamp.

8. The electric lamp as claimed in claim 1, wherein a movement and/or brightness sensor is fitted on the second part of the rotary device, which faces the at least one vessel, or on the housing for accommodating an electrical or electronic circuit for lamp operation.

9. The electric lamp as claimed in claim 3, wherein each of the first and second parts of the rotary device has a stop, the two stops being arranged such that, at a specific angle of rotation, two stops come into contact with one another between the first and second parts of the rotary device and prevent any further rotation.

* * * * *